US011319617B2

(12) United States Patent
Aoki et al.

(10) Patent No.: US 11,319,617 B2
(45) Date of Patent: May 3, 2022

(54) PRODUCTION METHOD FOR RING-ROLLED MATERIAL OF FE—NI-BASED SUPERALLOY

(71) Applicant: HITACHI METALS, LTD., Tokyo (JP)

(72) Inventors: Chuya Aoki, Tokyo (JP); Tsuyoshi Fukui, Tokyo (JP); Daigo Ohtoyo, Tokyo (JP); Etsuo Fujita, Tokyo (JP); Naoyuki Iwasa, Tokyo (JP); Taku Hirosawa, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 17/276,332

(22) PCT Filed: Sep. 19, 2019

(86) PCT No.: PCT/JP2019/036756
§ 371 (c)(1),
(2) Date: Mar. 15, 2021

(87) PCT Pub. No.: WO2020/059797
PCT Pub. Date: Mar. 26, 2020

(65) Prior Publication Data

US 2022/0042144 A1 Feb. 10, 2022

(30) Foreign Application Priority Data

Sep. 19, 2018 (JP) ..... JP2018-174958

(51) Int. Cl.
*C22F 1/10* (2006.01)
*C22C 19/05* (2006.01)

(52) U.S. Cl.
CPC ..... *C22C 19/055* (2013.01); *C22F 1/10* (2013.01)

(58) Field of Classification Search
CPC ..... C22C 19/055; C22C 19/056; C22F 1/10
See application file for complete search history.

(56) References Cited

U.S. PATENT DOCUMENTS

2017/0114435 A1 4/2017 Aoki et al.

FOREIGN PATENT DOCUMENTS

| | | | |
|---|---|---|---|
| JP | 2011079043 | A | 4/2011 |
| JP | 5994951 | B2 | 9/2016 |
| KR | 20120017896 | A | 2/2012 |

OTHER PUBLICATIONS

"International Search Report—English language translation", International Application No. PCT/JP2019/036756, dated Nov. 12, 2019, 1 pp.

*Primary Examiner* — Jessee R Roe
(74) *Attorney, Agent, or Firm* — Myers Bigel, P.A.

(57) ABSTRACT

The present invention provides a method for producing a ring-rolled material of an Fe—Ni based superalloy which inhibits AGG, has a fine-grained structure having an ASTM grain size number of at least 8, and has high circularity. A method for producing a ring-rolled material of an Fe—Ni based superalloy having a composition of an Alloy 718 comprises: heating a ring-shaped material for ring rolling having the composition, in a temperature range of 900° C. to 980° C., and performing finishing ring rolling, as a finishing ring rolling step; heating the ring-rolled material that has been subjected to the finishing ring rolling, in a temperature range of 980 to 1010° C.; and correcting ellipticalness while expanding a diameter of the ring-rolled material by using a ring expander.

3 Claims, 1 Drawing Sheet

PRODUCTION METHOD FOR RING-ROLLED MATERIAL OF FE—NI-BASED SUPERALLOY

RELATED APPLICATIONS

This application is a 35 U.S.C. § 371 national stage application of PCT Application No. PCT/JP2019/036756, filed on Sep. 19, 2019, which claims priority from Japanese Patent Application No. 2018-174958, filed on Sep. 19, 2018, the contents of which are incorporated herein by reference in their entireties. The above-referenced PCT International Application was published in the Japanese language as International Publication No. WO 2020/059797A1 on Mar. 26, 2020.

TECHNICAL FIELD

The present invention relates to a method for producing a ring-rolled material of an Fe—Ni based superalloy.

BACKGROUND ART

Alloy 718 is a superalloy which has excellent mechanical properties, and accordingly, has been most widely used for turbine parts of aircraft engines. Because a high fatigue strength is required for rotating parts formed from Alloy 718 which is used for aircraft engines, the Alloy 718 constituting the parts is required to have a fine-grained structure. For example, in the case of a ring-shaped rotating part, usually, a billet is prepared from an ingot, and then this is subjected to hot forging, ring rolling, and closed die forging; and a fine-grained structure is created in the rotating part, for which a pinning effect of a delta phase is made use of. On the other hand, from the viewpoint of production cost, it is desirable that a converted shape by a closed die forging be a shape in which excess thickness of a product is made as thin as possible, and for this reason, a particularly high circularity is required for the ring-shaped material for closed die forging, which is supplied to the closed die forging.

However, when the ring-shaped material for the closed die forging is prepared, if circularity correction is performed in order to obtain a high degree of circularity, there is a case in which so-called abnormal grain growth (hereinafter referred to as "AGG" in some cases) is caused, which is a phenomenon in which, while the material is subsequently heated to a closed die forging temperature, the grains rapidly become coarse beyond the pinning of the delta phase. Due to the occurrence of the AGG, there is a case in which the grain size becomes coarser by 10 times or more; and the grain cannot be completely refined in the closed die forging step, and as a result, a problem arises in that coarse grains remain in the product, and fatigue properties are greatly impaired. As a method for avoiding the AGG, in Patent Document 1, for example, it is described that a condition is effective as a condition of hot working, which satisfies the following Expression (1) or (2) between an effective strain and an effective strain rate.

$$[\text{effective strain}] \geq 0.139 \times [\text{effective strain rate } (/\text{sec})]^{-0.30} \quad (1)$$

$$[\text{effective strain}] \leq 0.017 \times [\text{effective strain rate } (/\text{sec})]^{-0.34} \quad (2)$$

REFERENCE DOCUMENT LIST

Patent Document

Patent Document 1: JP 5994951 B

SUMMARY OF THE INVENTION

Problem to be Solved by the Invention

The invention described in Patent Document 1 is excellent in that the AGG can be prevented by the condition represented by Expression (1) or (2), in the first hot working. However, it is not practical from the viewpoint of the pressing capability to apply the effective strain satisfying Expression (1) to the entire region of the ring-shaped material for the closed die forging, only by the step of the circularity correction. On the other hand, it is difficult to control the application of the effective strain satisfying Expression (2) to the ring-shaped material for the closed die forging, because the strain remaining in the ring-rolled material at the end of ring rolling is not uniform. Thus, even though ways of preventing the AGG independently by each of the two steps of the ring rolling step and the circularity correcting step have been considered, it has been difficult to solve the problem of the occurrence of AGG during heating of the closed die to the forging temperature.

An object of the present invention is to provide a method for producing a ring-rolled material of an Fe—Ni based superalloy, which has a high circularity, can inhibit AGG, and can inhibit grain growth.

Means for Solving the Problem

The present invention has been made in light of the problem described above. Specifically, the present invention provides a method for producing a ring-rolled material of an Fe—Ni based superalloy having a composition including, by mass %, up to 0.08% of C, 50.0 to 55.0% of Ni, 17.0 to 21.0% of Cr, 2.8 to 3.3% of Mo, 0.20 to 0.80% of Al, 0.65 to 1.15% of Ti, 4.75 to 5.50% of Nb+Ta, up to 0.006% of B, and the balance of Fe with inevitable impurities, using ring rolling, the method comprising:

a finishing ring rolling step, as a final step of the ring rolling, of heating a material for ring rolling in a temperature range of 900 to 980° C., and expanding a diameter of the material for ring rolling and also pressing the material for ring rolling in an axial direction thereof by using a ring rolling mill having a pair of rolling rolls including a main roll and a mandrel roll, and a pair of axial rolls;

a heating step of heating a ring-rolled material that has been rolled by the finishing ring rolling step, in a temperature range of 980 to 1010° C.; and a circularity correcting step of improving a circularity of the ring-rolled material that has been heated by the heating step, while expanding a diameter of the ring-rolled material by using a ring expander including a pipe-expanding cone and a pipe-expanding die.

In addition, in the method for producing the ring-rolled material of the Fe—Ni based superalloy according to the present invention, it is preferable that, in the circularity correcting step, a diameter expansion rate for an outer diameter of the ring of the ring-rolled material be up to 0.8%.

In addition, it is preferable that the present invention further comprise an intermediate ring rolling step, as a pre-step of the finishing ring rolling step, of heating the material for ring rolling to a temperature of higher than 980° C. and up to 1010° C., and expanding a diameter of the material for ring rolling which has been heated to the temperature, and also pressing the material for ring rolling in an axial direction thereof by using a ring rolling mill having a pair of rolling rolls including a main roll and a mandrel roll, and a pair of axial rolls.

Effects of the Invention

According to the present invention, the ring-rolled material of the Fe—Ni based superalloy can be obtained, which has a high circularity, inhibits AGG, and inhibits grain growth. For example, the reliability for the fatigue characteristics of the turbine parts and the like of aircraft engines can be improved, for which this ring-rolled material is used.

MODE FOR CARRYING OUT THE INVENTION

Figure 1:
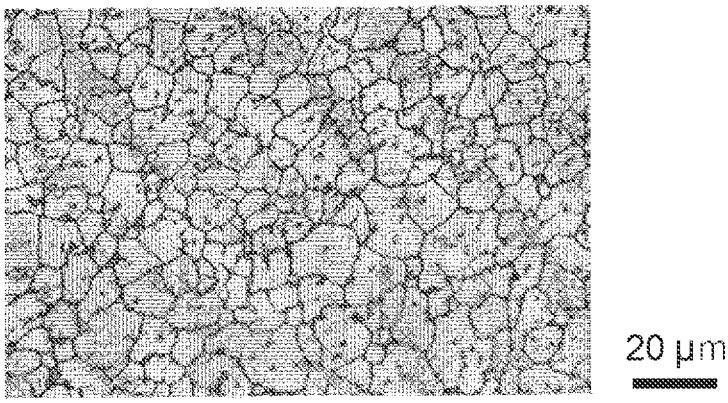
FIG. 1 is a photograph of the microstructure of a ring-rolled material to which a method for producing the ring-rolled material of the present invention has been applied.

The most significant characteristic of the present invention is in preventing AGG by optimizing conditions of a ring rolling step and a circularity correcting step of a ring-rolled material. The AGG occurs in heat treatment after low strain has been applied to an initial state in which no strain remains. The technical concept of the present invention for inhibiting the occurrence of the AGG is as follows.

In a state in which strain is sufficiently stored by ring rolling, the strain stored in a ring-rolled material is reduced to as near zero as possible by static recrystallization due to heat treatment. If the circularity correction (application of low strain) is performed from this state, the AGG can be avoided.

The alloy composition prescribed in the present invention is known as that of an NCF718 alloy (Fe—Ni based superalloy) according to JIS-G4901, and accordingly, description of the composition will be omitted. Hereinafter, the NCF718 alloy will be simply referred to as "Alloy 718". The composition of the Alloy 718 may include elements in a range of up to 0.35% of Si, up to 0.35% of Mn, up to 0.015% of P, up to 0.015% of S, and up to 0.30% of Cu, in addition to each element which is prescribed in the present invention.

Ring Rolling Steps

First, the "finishing ring rolling step" will be described, which is characteristic in the present invention. The "finishing ring rolling step" is the final step of ring rolling steps.

A material for ring rolling for the finishing ring rolling step is prepared, which has a composition of the Alloy 718, and the material for ring rolling is heated in a temperature range of 900 to 980° C. Then, by using a ring rolling mill which has a pair of rolling rolls composed of a main roll and a mandrel roll, and a pair of axial rolls, the finishing ring rolling is performed which expands a diameter of the heated material for ring rolling and also presses the material for ring rolling in its axial direction.

The occurrence of the AGG in the Alloy 718 was confirmed as a phenomenon in which when a low strain is introduced into the Alloy 718 having a fine-grained structure, grains remarkably grow beyond pinning during subsequent heat treatment. As described above, it is difficult to control the introduction of slight strain to avoid the occurrence of the AGG in the step of correcting the circularity of the ring-rolled material, because the strain remains with a distribution in the ring-rolled material at the time when the ring rolling has ended. However, if the ring-rolled material is brought into a state in which sufficient strain is stored in the ring-rolled material in the finishing ring rolling step, and it is then reheated, it is possible to reduce the stored strain as much as possible in the entire ring-rolled material due to the occurrence of static recrystallization. Thereby, it becomes possible, for example, to control the application of a limited low strain in the circularity correcting step, and it is possible to prevent the occurrence of the AGG. Accordingly, in the finishing ring rolling step, the heating temperature of the material for ring rolling is set to a range of 900 to 980° C., and the ring-rolled material is subjected to the ring rolling. Thereby, the recrystallization during the ring rolling is inhibited, the ring-rolled material at the time when the ring rolling has ended is controlled to have an unrecrystallized or partially recrystallized structure therein, and the strain remains in the ring-rolled material. If the heating temperature exceeds 980° C., the recrystallization during the ring rolling is promoted, and the strain cannot be sufficiently stored in the ring-rolled material. On the other hand, if the heating temperature is lower than 900° C., the recrystallization is almost completely inhibited, but the rolling load becomes remarkably high, which makes the ring rolling difficult. Accordingly, the heating temperature of the material for ring rolling is set to 900 to 980° C. The lower limit of the heating temperature is preferably 910° C., and more preferably 920° C. The upper limit of the heating temperature is preferably 970° C., and more preferably 960° C.

The ring rolling step may be repeated after reheating. In this case, an "intermediate ring rolling step" may be applied as a pre-step of the finishing ring rolling step.

The reason the heating temperature in the intermediate ring rolling step is set to a range of higher than 980° C. to 1010° C. or lower is to obtain a sufficient recrystallized structure. In a temperature range of 980° C. or lower, it becomes difficult to obtain sufficient recrystallization, and if the temperature exceeds 1010° C., the grains tend to become coarse. The lower limit of the heating temperature in the intermediate ring rolling step is preferably 985° C., and it is preferable to perform the ring rolling step at a temperature higher than in the finishing ring rolling step by at least 10° C. It is also acceptable to subject the material for ring rolling heated at a heating temperature of the intermediate ring rolling step to the intermediate ring rolling, and thereby create a fine-grained structure therein due to promoted recrystallization, and set a heating temperature at the time of final (finish) ring rolling to a temperature range of 900 to 980° C., and perform the final ring rolling. In other words, in a case in which heating and ring rolling are performed a plurality of times, it is acceptable to heat the material for ring rolling in a temperature range of 900 to 980° C. at the time when the final (finish) ring rolling is performed.

Heating Step

When the strain remains in the ring-rolled material in the above ring rolling step, and the recrystallization is generated in the entire ring-rolled material by heating in the subsequent heating step, it becomes easy to control the application of the low strain, which avoids the AGG, in the step of correcting the circularity of the ring-rolled material. Accordingly, the ring-rolled material is heated in a temperature range of 980 to 1010° C. before the circularity correcting step. If the temperature is lower than 980° C., the recrystallization is not promoted, and the stored strain cannot be sufficiently reduced. On the other hand, if the temperature exceeds 1010° C., the risk of the grain growth is high, and the ring-rolled material may become inappropriate in terms of the inner quality of a rough material before the closed die forging. The lower limit of the heating temperature is preferably 985° C., and more preferably 990° C. In addition, the upper limit of the heating temperature is preferably 1005° C., and more preferably 1000° C.

Circularity Correcting Step

The ring-rolled material heated in the above heating step is subjected to circularity correction which uses a ring expander including a pipe-expanding cone and a pipe-expanding die, expands a diameter of the heated ring-rolled material while pressing the pipe-expanding die against the inner diameter side of the ring-rolled material, thereby corrects ellipticalness, and improves circularity. In the circularity correcting step, such a low strain must be applied so as to avoid the occurrence of the AGG, and accordingly, it is preferable to perform the step at a diameter expansion rate of up to 0.8% at the outer diameter of the ring. The diameter expansion rate is more preferably up to 0.6%, and further preferably up to 0.5%. The diameter expansion rate is obtained by $[(D_{EXP}-D_{RM})/D_{RM}]\times100[\%]$ (wherein $D_{EXP}$ is an outer diameter of the ring after the circularity correction, and $D_{RM}$ is an outer diameter of the ring before the circularity correction). Due to the circularity correcting step, the circularity of the ring-rolled material can be controlled to up to 3 mm. For information, the circularity is determined by $(D_{MAX}-D_{MIN})/2$ [mm] (where $D_{MAX}$ is the maximum value of an outer diameter of the ring after the circularity correction and $D_{MIN}$ is the minimum value of an outer diameter of the ring after the circularity correction).

The circularity correction may be performed in a plurality of separate steps. In this case, it is acceptable to apply the heating step only for the final finish circularity correction; and to perform the circularity correction without reheating, in circularity correction before then, or to perform the circularity correction after reheating at a low temperature, so as not to release the stored strain which has been left in the ring rolling. In a case in which the ring-rolled material is reheated at a low temperature, the temperature is set to 960° C. or lower, which avoids an aging temperature region of 600 to 760° C. The reheating temperature is preferably 950° C. or lower, and more preferably 940° C. or lower.

When the above ring-rolled material of the present invention is used as a material for hot forging, and pre-forging heating at 980 to 1010° C. is applied thereto, such a microstructure can be formed so as to inhibit the occurrence of the AGG and the grain growth. The lower limit of the heating temperature before forging is preferably 985° C., and more preferably 990° C. The upper limit of the heating temperature is preferably 1005° C., and more preferably 1000° C.

In addition, the ring-rolled material has high circularity, and accordingly, is suitable as a material for hot forging for closed die forging.

EXAMPLES

Example 1

A ring-shaped material for ring rolling was obtained which was prepared by subjecting a billet, having a chemical composition shown in Table 1, which corresponds to that of an Fe—Ni based superalloy (Alloy 718), to hot forging in a temperature range of 980 to 1010° C., and then to piercing. This material for ring rolling was heated at a heating temperature in a range of higher than 980° C. to 1000° C. or lower, and was subjected to the intermediate ring rolling. Next, the ring-rolled material was heated at a heating temperature of 960° C., and then was subjected to the finishing ring rolling; and a ring-rolled material was obtained which had an outer diameter of approximately 1300 mm, an inner diameter of approximately 1100 mm, and a height of approximately 200 mm. The obtained ring-rolled material was slightly elliptical. The circularity exceeded about 3 mm.

After the finishing ring rolling has ended, the ring-rolled material was heated at a heating temperature of 980° C. Then, the ring-rolled material was subjected to the circularity correction so that the diameter expansion amount was in a range of 5 to 10 mm, which used a ring expander including a pipe-expanding cone and a pipe-expanding die. The diameter expansion rate at this time was 0.3%. The circularity of this ring-rolled material was 1.5 mm after the circularity correction. After the circularity correction, the ring-rolled material was heated for the closed die forging at 1000° C. for 3 hours, and an Example of the present invention (No. 1) was prepared. For comparison, Comparative Examples (Nos. 11 to 14) were prepared in which the heating temperatures of the materials for the rolling to be subjected to the finishing ring rolling and the heating temperatures of the ring-rolled materials to be subjected to the circularity correction were changed. The heating temperatures are shown in Table 2.

The ring rolling mill which was used for producing the ring-rolled material has a function of expanding the inner diameter and the outer diameter of the material for ring rolling, by the pair of rolling rolls composed of the main roll and the mandrel roll, and pressing the material for ring rolling in its height (thickness) direction by the pair of axial rolls.

TABLE 1

| (mass %) | | | | | | | | |
|---|---|---|---|---|---|---|---|---|
| C | Ni | Cr | Mo | Al | Ti | Nb | B | Balance |
| 0.023 | 54.9 | 17.97 | 2.98 | 0.48 | 0.95 | 5.44 | 0.0029 | Fe with inevitable impurities |

Figure 2:
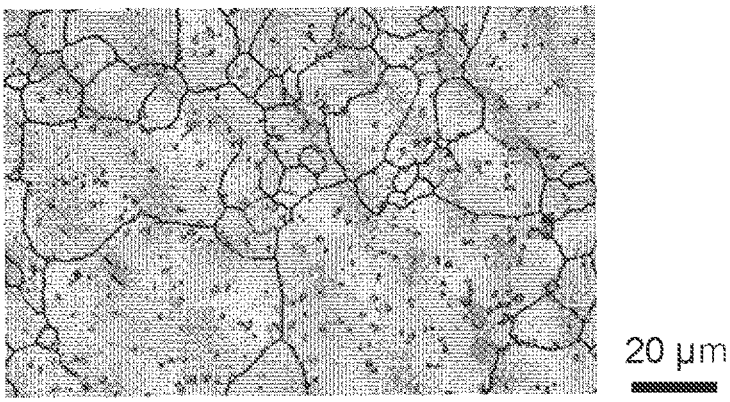
FIG. 2 is a photograph of the microstructure of a ring-rolled material of a Comparative Example in which abnormal grain growth has occurred.

After the ring rolled material has been subjected to heating for the closed die forging, microstructures of the entire cross sections of the ring-rolled materials in radial directions of the rings in the Example of the present invention and Comparative Examples were observed with an optical microscope. The grain size number was measured according to the method defined in ASTM E112, and the results are shown in Table 2. In No. 1 of the present invention, after heating at 1000° C., which assumes the closed die forging, a fine-grained structure was obtained which had an ASTM grain size number of 8 or more. By using such a uniform fine-grained material, a good microstructure can be obtained even after die forging for forming a final product. On the other hand, in Nos. 11 to 14 of Comparative Examples, a large number of coarse grains were observed which had a grain size number of 6 or less. In Nos. 11, 13, and 14, the heating temperature of the finish rolling ring rolling was high, recrystallization occurred during rolling, and a sufficient amount of strain was not stored; and accordingly, sufficient recrystallization did not occur by heating before the circularity correction. In No. 12, the heating temperature of the finishing ring rolling was equivalent to that of the present invention, and sufficient strain was stored, but it is considered that the heating temperature before the circularity correction was low and the recrystallization was insufficient. FIG. 1 shows a photograph of the microstructure of the Example of the present invention, and FIG. 2 shows a photograph of the microstructure of Comparative Example No. 11.

TABLE 2

| No. | Finishing ring rolling | Circularity correction | Diameter expansion ratio | Circularity | Grain size after heating at 1000° C. | Remarks |
|---|---|---|---|---|---|---|
| 1 | 960° C. | 980° C. | 0.3% | 1.5 mm | GS# 8-10.5 | Example of present invention |
| 11 | 990° C. | 900° C. | 0.3% | 0.5 mm | Occurrence of large numbers of GS# 6 or less | Comparative Example |
| 12 | 965° C. | 965° C. | 0.6% | 0.5 mm | Occurrence of large numbers of GS# 6 or less | Comparative Example |
| 13 | 990° C. | 980° C. | 0.8% | 1.5 mm | Occurrence of large numbers of GS# 6 or less | Comparative Example |
| 14 | 1010° C. | 990° C. | 0.6% | 0.2 mm | Occurrence of large numbers of GS# 6 or less | Comparative Example |

As described above, it is understood that when the production method of the present invention is applied, a ring-rolled material of an Fe—Ni based superalloy can be obtained which has high circularity, inhibits AGG, and has a fine-grained structure having an ASTM grain size number of 8 or more. As a result, the above ring-rolled material of the Fe—Ni based superalloy can improve the reliability for fatigue characteristics of turbine parts and the like of aircraft engines.

The invention claimed is:

1. A method for producing a ring-rolled material of an Fe—Ni based superalloy having a composition including, by mass %, up to 0.08% of C, 50.0 to 55.0% of Ni, 17.0 to 21.0% of Cr, 2.8 to 3.3% of Mo, 0.20 to 0.80% of Al, 0.65 to 1.15% of Ti, 4.75 to 5.50% of Nb+Ta, up to 0.006% of B, and the balance of Fe with inevitable impurities, using ring rolling, the method comprising:

a finishing ring rolling step, as a final step of the ring rolling, of heating a material for ring rolling in a temperature range of 900 to 980° C., and expanding a diameter of the material for ring rolling and also pressing the material for ring rolling in an axial direction thereof by using a ring rolling mill having a pair of rolling rolls including a main roll and a mandrel roll, and a pair of axial rolls;

a heating step of heating a ring-rolled material that has been rolled by the finishing ring rolling step, in a temperature range of 980 to 1010° C.; and a circularity correcting step of improving a circularity of the ring-rolled material that has been heated by the heating step, while expanding a diameter of the ring-rolled material by using a ring expander including a pipe-expanding cone and a pipe-expanding die.

2. The method for producing the ring-rolled material of the Fe—Ni based superalloy according to claim 1, wherein in the circularity correcting step, a diameter expansion rate for an outer diameter of a ring of the ring-rolled material is up to 0.8%.

3. The method for producing the ring-rolled material of the Fe—Ni based superalloy according to claim 1, further comprising an intermediate ring rolling step, as a pre-step of the finishing ring rolling step, of heating the material for ring rolling to a temperature range of higher than 980° C. and up to 1010° C., and expanding the diameter of the material for ring rolling that has been heated at the temperature range and also pressing the material for ring rolling in an axial direction thereof by using a ring rolling mill having a pair of rolling rolls including a main roll and a mandrel roll, and a pair of axial rolls.

* * * * *